US006302001B1

(12) United States Patent
Karle

(10) Patent No.: US 6,302,001 B1
(45) Date of Patent: Oct. 16, 2001

(54) ACTUATING TOOL

(75) Inventor: Otmar Karle, Vorstetten (DE)

(73) Assignee: Willi Hahn GmbH & Co. KG, Schonach (DE)

( * ) Notice: Subject to any disclaimer, the term of this patent is extended or adjusted under 35 U.S.C. 154(b) by 0 days.

(21) Appl. No.: 09/529,042

(22) PCT Filed: Jul. 4, 1998

(86) PCT No.: PCT/EP98/04128

§ 371 Date: Jul. 5, 2000

§ 102(e) Date: Jul. 5, 2000

(87) PCT Pub. No.: WO99/19119

PCT Pub. Date: Apr. 22, 1999

(30) Foreign Application Priority Data

Oct. 9, 1997 (DE) ..... 197 44 534

(51) Int. Cl.[7] ..... B25B 23/00
(52) U.S. Cl. ..... 81/436; 81/13
(58) Field of Search ..... 81/57.34, 436, 81/438, 451, 452, 13, 55

(56) References Cited

U.S. PATENT DOCUMENTS

| | | | | |
|---|---|---|---|---|
| 2,152,977 | * | 4/1939 | Schindel | 411/190 |
| 2,667,194 | * | 1/1954 | Fischer et al. | 81/438 |
| 2,806,706 | * | 9/1957 | Fitch | 279/79 |
| 3,347,293 | * | 10/1967 | Clark | 81/438 |
| 3,739,825 | * | 6/1973 | Knox | 81/451 |
| 3,935,762 | * | 2/1976 | Tudisco | 81/177.85 |
| 4,096,896 | | 6/1978 | Engel . | |
| 4,246,811 | | 1/1981 | Bondhus et al. . | |
| 4,535,658 | * | 8/1985 | Molinari | 81/177.85 |

FOREIGN PATENT DOCUMENTS

| | | | | |
|---|---|---|---|---|
| 3937527A1 | | 5/1991 | (DE) . | |
| G-9410174.4 | * | 11/1994 | (DE) | 81/436 |
| 4416268-A | * | 11/1995 | (DE) | 81/452 |
| WO97/06930 | | 2/1997 | (DE) . | |
| 29708764U1 | | 8/1997 | (DE) . | |

OTHER PUBLICATIONS

Einfuhrung In Die Din–Normen.

* cited by examiner

*Primary Examiner*—Joseph J. Hail, III
*Assistant Examiner*—David B. Thomas
(74) *Attorney, Agent, or Firm*—Morriss, Bateman, O'Bryant & Compagni

(57) ABSTRACT

The invention relates to an actuating tool for a fastener having an internal polygon arrangement, particularly a screw, with a tool head having an external polygon arrangement to fit into this internal polygon arrangement, wherein the tool head has a circumferential recess to receive a spring washer. It is provided that the width of the recess (17) is greater than the dimension of the spring washer (21) measured in the direction of the width, and the spring washer (21) is elastically supported at least in partial areas against the sidewalls (41, 43) of the recess (17).

21 Claims, 4 Drawing Sheets

ACTUATING TOOL

Figure 1:
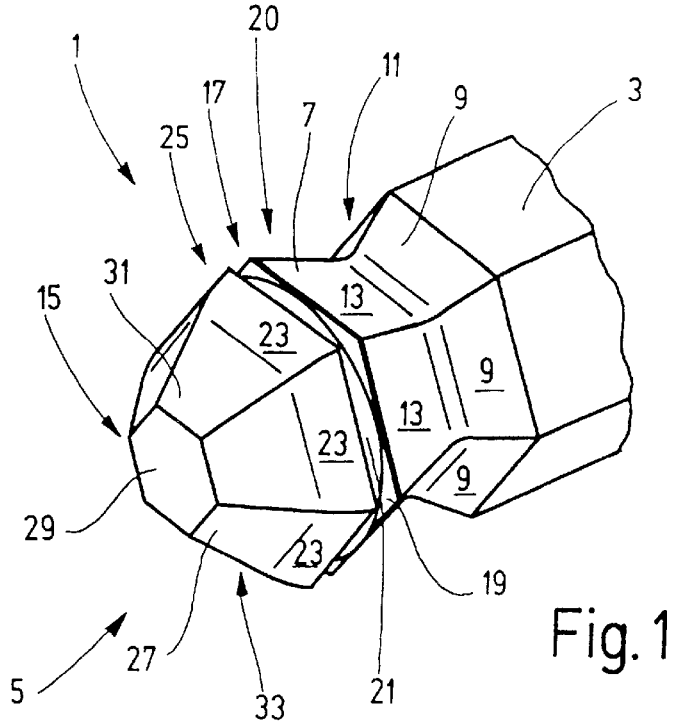

The invention relates to an actuating tool for a fastener having an internal polygon arrangement in accordance with the preamble of claim 1.

An actuating tool of the initially described type is known from German Patent DE-PS 44 16 268. It serves to screw in or unscrew hexagon socket screws. For this purpose, the tool is provided with a hexagon socket insert bit that fits into the hexagon socket of the screw. In an insertion element that is provided with the hexagon socket insert bit, an elastic clamping device is arranged, which is accommodated in a recess of the insertion element. When the tool is inserted into the hexagon socket, a force is applied to the clamping arrangement designed as a snap ring. The beveled open ends of the snap ring thereby move toward each other so that the outside diameter of the ring is reduced. This allows the insertion element to slide into the hexagon socket of the screw. The disadvantage of this prior-art actuating tool is that the snap ring can very easily slip within the recess, which in many cases makes it impossible to insert the tool into the hexagon socket. A further disadvantage is that the snap ring is compressed in such a way that the bevels of the ends do not project above the edge of the recess so that a secure hold of the tool within the hexagon socket is not ensured in all cases.

German Utility Model 297 08 764 discloses a screwdriver with a polygonal engagement area. It is provided with a recess into which a plastic ring is inserted, which is elastically deformed when the tool is pushed into the internal polygon arrangement of a screw. Another embodiment of the screwdriver provides for a spring washer with a rosette-like contour to be inserted into the recess, whereby the areas between its rounded edges are curved. With frequent use, however, such clamping elements wear quickly, particularly the plastic ring. The spring washer with the rosette-type contour is complex and costly to produce.

Thus, the object of the invention is to create an actuating tool for a fastener with an internal polygon arrangement, which obviates the initially described disadvantages.

This object is attained by means of an actuating tool with the features cited in claim 1. The tool is distinguished, in particular, in that a recess for a spring washer is made in a tool head with an external polygon arrangement, that the spring washer is in partial areas elastically supported against sidewalls of the recess and in its no-load state projects above at least one, preferably above each face of the external polygon arrangement, and that the depth of the recess is greater than or equal to the dimension of the spring washer measured in the direction of the depth. The elastic support advantageously ensures that the spring washer is centered when the tool head is first inserted into an internal polygon arrangement of a screw and that it retains this position after the tool is withdrawn from the screw. Thus, the spring washer is fixed or braced by the elastic support within the recess. Consequently, the insertion force during subsequent insertion processes remains nearly constant since the limiting edges of the internal polygon arrangement strike substantially the same position of the spring washer when the tool is inserted. As a result, the force is transmitted from the limiting edges to the spring washer at substantially always the same tangent angle. The actuating tool according to the invention is thus distinguished by the fact that the spring washer cannot slip uncontrollably within the recess, which ensures simple and secure insertion of the tool at a nearly constant insertion force. Since the spring washer in its no-load state projects above at least one, preferably above each flat face of the external polygon arrangement, constant forces act on the spring washer from each flat face of the internal polygon arrangement when the tool is inserted. The fact that the depth of the recess is equal to or greater than the dimension of the spring washer measured in the direction of the depth ensures that the spring washer is completely received by the recess when a force is applied.

A preferred embodiment provides that the spring washer forms a turn in the manner of a helical spring. In other words, the spring washer is crossed, with the opposite ends of the preferably open spring washer being laterally offset. Through this crossing of the spring washer, the turn of which thus extends along an imaginary helix, said spring washer is at least in partial areas elastically supported against the sidewalls of the recess. This ensures secure positioning of the spring washer within the recess. In a preferred embodiment, the recess extends in a plane, whereby a normal of said plane coincides with a longitudinal axis of the actuating tool. The spring washer thus extends in a concentric circular path around the longitudinal axis of the tool.

Furthermore, it is preferably provided that the ends of the open spring washer nearly touch each other in their loaded state. A nearly closed spring washer is thus formed, which is elastically supported against the flat faces of the internal polygon arrangement. This achieves a secure hold of the tool within the screw.

Furthermore, it is preferably provided that the recess is formed as a substantially rectangular or U-shaped groove. Consequently, the crossed spring washer can at least in partial areas be supported against the sides of the groove. Thus, it retains its position with respect to the longitudinal axis of the tool.

A particularly preferred embodiment provides that the spring washer is formed by preferably a spring-hard wire, which can have a substantially circular cross section. Alternatively, it may be provided that the spring washer has an angular cross section, which is preferably triangular, rectangular or hexagonal. The cross section may also be trapezoidal. An angular cross section has the particular advantage that a diagonal face of the spring washer meets the limiting edges of the internal polygon arrangement. This causes substantially equal forces to act during insertion, since the limiting edges meet the diagonal to create a radial force component that pushes the spring washer into the recess. This is particularly advantageous if the dimensions of the tool and/or the internal polygon arrangement of the screw have tolerances.

A preferred embodiment provides that the diameter of the cross section of the spring washer be 0.07 to 0.14 times the width across flats defined by the polygon arrangement.

In a particularly preferred embodiment, the actuating tool is distinguished by the fact that the tool head is formed by two spherical segments, that their bases are facing each other and are spaced at a distance from each other, and that their center points—measured in the direction of the longitudinal axis of the actuating tool—are preferably spaced a distance from each other. Thus, a spherical head is formed, which comprises two halves of a sphere, has the dimensions of the external polygon arrangement, and permits insertion of the actuating tool into the internal polygon arrangement even if the longitudinal axis of the actuating tool is not aligned with the longitudinal axis of the screw. This is particularly advantageous if the screw is located behind an obstacle. Furthermore, it is provided that the center point of the first spherical segment and the center point of the second spherical segment are located along the longitudinal axis of the actuating tool and that the center points are located within a space between the bases of the spherical segments.

A particularly preferred embodiment provides that one spherical segment of the spherical head is arranged on a shank of the actuating tool, and that on the other spherical segment a truncated cone is preferably attached whose lateral surface forms an angle $\alpha$ with the normal, i.e. the longitudinal axis of the actuating tool. Furthermore, it is preferably provided that the center axis of the truncated cone coincides with the longitudinal axis of the actuating tool. The truncated cone attached to the spherical segment forms an insertion area of the tool, which on the one hand limits a pivoting angle of the actuating tool with respect to the longitudinal axis of the screws. On the other hand, it also prevents the tool head from being inserted into the internal polygon arrangement of the screw if the pivoting angle was selected too large. This prevents damage to the screw or the tool. Specifically, the maximum permissible pivoting angle can be 3° to 40°, preferably 30°. Thus, it is provided that the lateral surface forms a 30° angle with the normal, i.e. the longitudinal axis of the actuating tool.

Finally, a preferred exemplary embodiment provides that the truncated cone has an external polygon arrangement on its lateral surface, whereby the external polygon arrangement of the tool head merges into the polygon arrangement of the truncated cone. This ensures that, if the actuating tool is pivoted, a force transmission is possible also via the polygon arrangement of the truncated cone. Moreover, at least two faces of the polygon arrangement of the truncated cone contact the opposite flat faces of the internal polygon arrangement when the maximum pivoting angle is reached. Thus, said faces lie on top of each other and thereby prevent impermissibly high surface pressures, so that neither the screw nor the actuating tool is damaged.

Additional advantageous embodiments are set forth in the subclaims.

Figure 2:
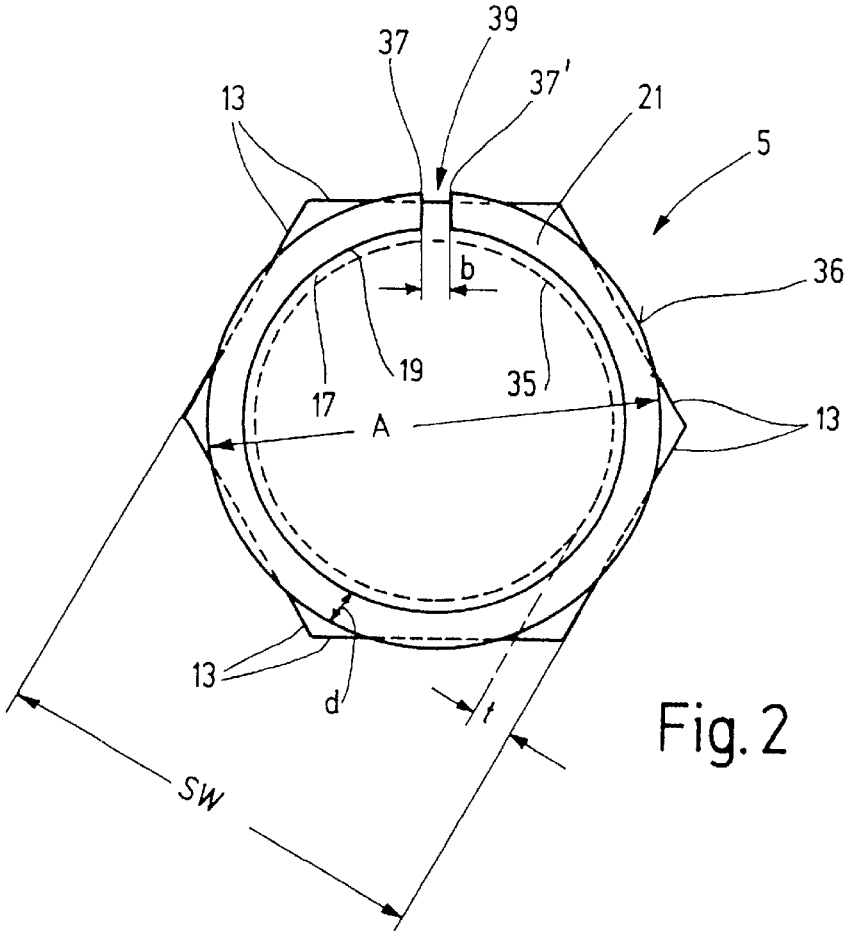
Figure 3:
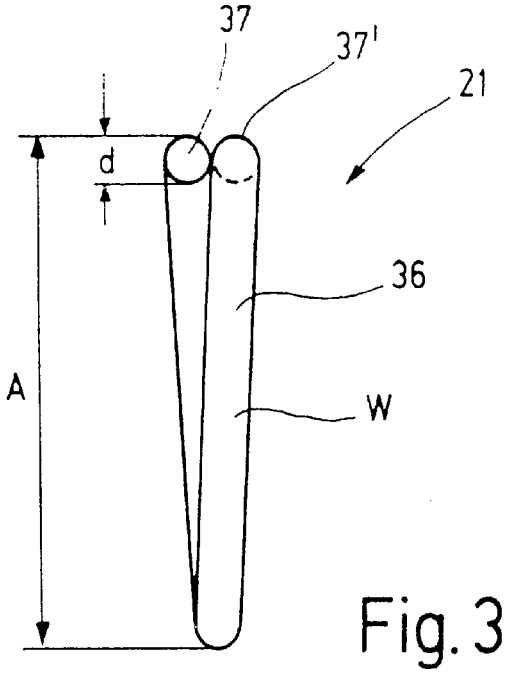
Figure 4:
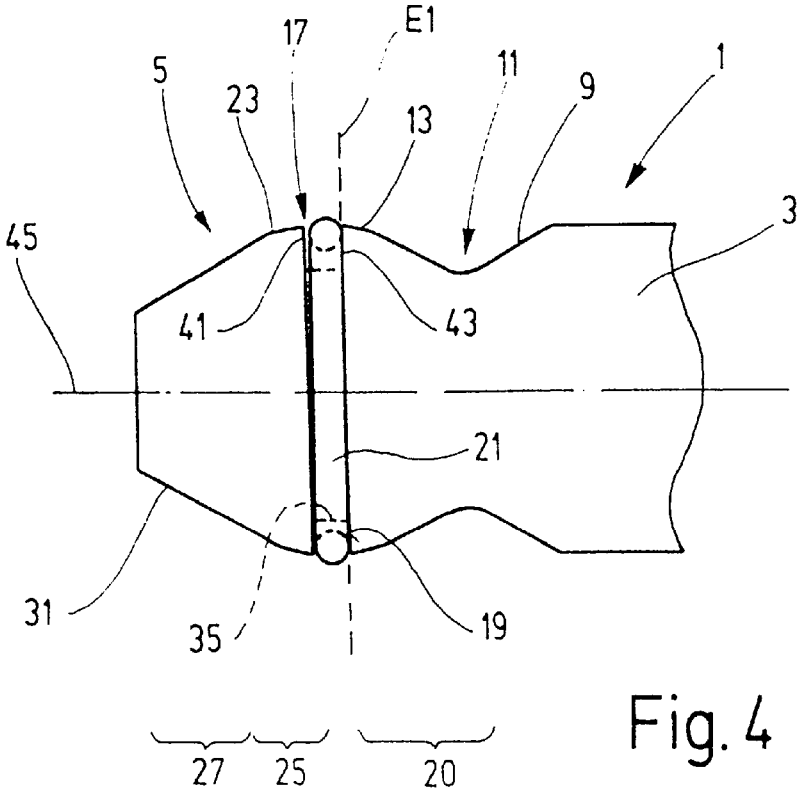
Figure 5:
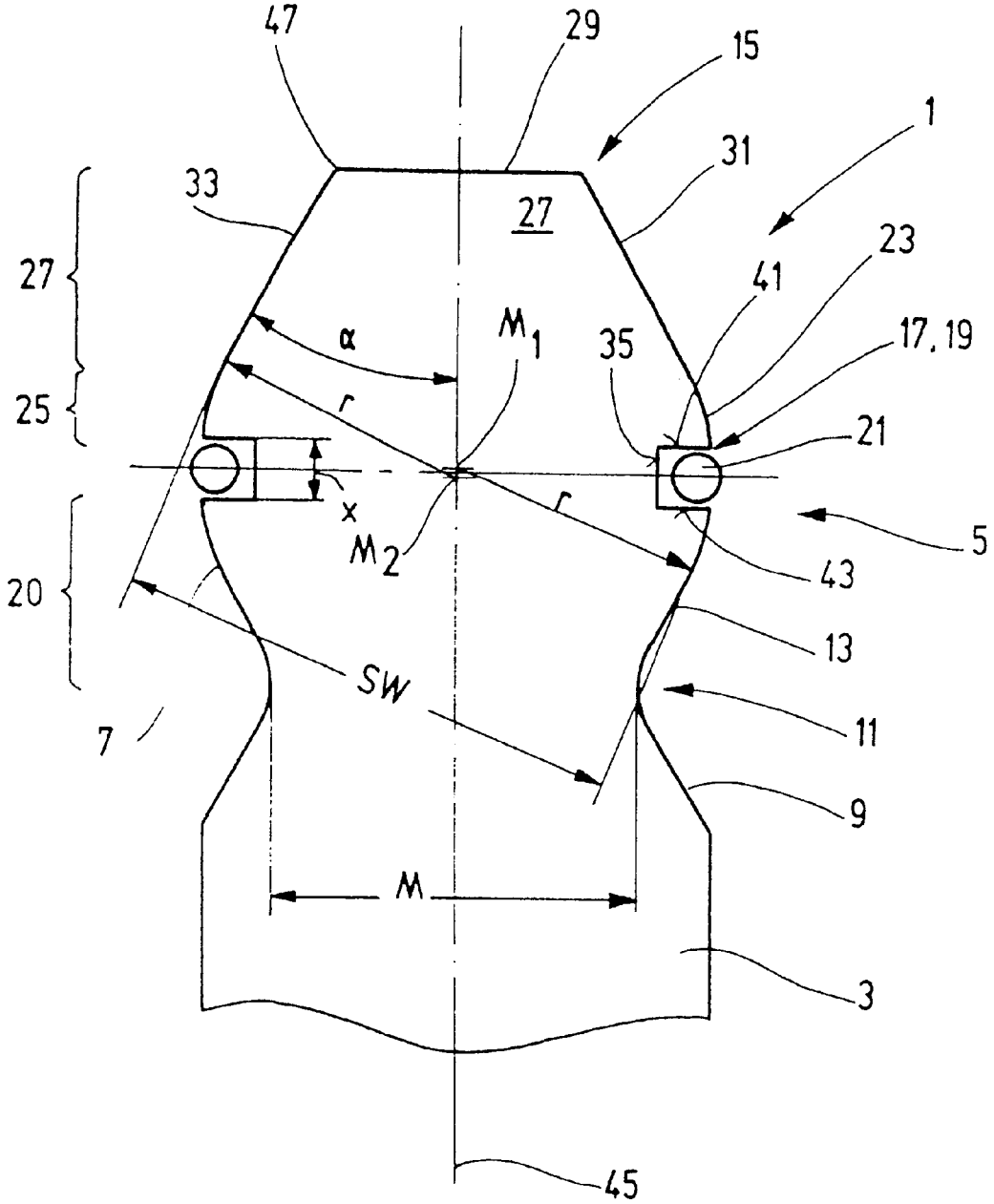

Below, the invention is explained in further detail by means of the drawing. The following show:

FIG. 1 a perspective view of a tool head of an actuating tool,

FIG. 2 a section through the tool head of FIG. 1,

FIG. 3 a spring washer,

FIG. 4 the tool head according to FIG. 1 in a side elevation,

FIG. 5 a section through the tool head parallel to the longitudinal axis of the actuating tool, and FIGS. 6*a* to 6*d* various embodiments of the spring washer.

Below, purely by way of example, an actuating tool is assumed to be realized, particularly a socket screw wrench for a fastener with an internal hexagon socket arrangement, particularly a hexagon socket screw. This internal polygon arrangement can of course also have a different number of corners. It is furthermore assumed, purely by way of example, that the actuating tool has a spherical-type tool head. The tool head may of course also be made in the form of a cylinder.

FIG. 1 depicts an actuating tool 1. This tool essentially comprises a cylindrical hexagon shank 3, which at its one end is provided with a tool head 5. This tool head 5 is made as a spherical hexagon head with an external hexagon arrangement 7. Hexagon tool head 5 is integrally formed with shank 3, whereby shank 3 comprises beveled faces 9 that slope toward a center axis of the tool so as to form a constriction 11. In the area of constriction 11, tool head 5 adjoins with faces 13, which increase toward an end 15 of tool head 5, i.e. their distance to the longitudinal axis of actuating tool 1 increases. In the further course of tool head 5, a recess 17 is provided, which is realized as a substantially rectangular or U-shaped groove 19, also referred to as neck. In the area between constriction 11 and groove 19, tool head 5 is formed by a first spherical segment 20. Groove 19 accommodates a spring washer 21. In the further course of the tool head, toward end 15, outwardly curved faces 23 sloping toward the center axis of actuating tool 1 adjoin groove 19. Faces 23 are the outer faces of a second spherical segment 25 of tool head 5 to which a truncated cone 27 is attached. Said truncated cone 27 with its truncated face 29 forms the end 15 of the actuating tool 1. The truncated cone, along its lateral surface 31, is provided with a polygon arrangement, particularly a hexagon arrangement 33. It is clearly apparent from FIG. 1 that the external hexagon arrangement 7, or tool head 5, is formed by the first spherical segment 20, the second spherical segment 25, and the truncated cone 27. In other words, faces 13 of the first spherical segment 14, faces 23 of the second spherical segment 25, and the lateral surface 31 each merge into each other.

FIG. 2 depicts an enlarged sectional view of tool head 5. It is readily apparent that the preferably open spring washer 21 is arranged in groove 19. It is spaced at a distance from a groove bottom 35 of groove 19. Depth t of recess 17 or groove 19 is selected in such a way that spring washer 21, the cross section of which has a diameter d, can be completely accommodated by groove 19 in its loaded state. "Loaded state" in terms of the application means that a force is applied from the outside to spring washer 21 along its lateral surface 36, which pushes it or its ends 37 and 37' together. It is readily apparent that spring washer 21 projects above faces 13 and faces 23 (FIG. 4). The open spring washer 21 has an opening gap 39 whose width b is selected such that when a force is applied to spring washer 21, its outside diameter A is reduced so that it is completely accommodated by groove 19 or recess 17. Its ends 37 and 37' are thereby displaced toward each other such that the spring washer is nearly closed, i.e. ends 37 and 37' almost touch each other. The fact that there is a small distance between ends 37 and 37' in their loaded state provides for some residual elasticity, which permits ends 37 and 37' to move further toward each other. This may be required, for example, if actuating tool 1 is pivoted in relation to a screw. Ends 37 and 37' of spring washer 21 are preferably made with sharp edges and without burrs so that they form flat cross-sectional faces that nearly touch each other when spring washer 21 is loaded. FIG. 2 furthermore depicts a width across flats SW that is defined by a distance between two diametrically opposite faces. Diameter d of spring washer 21 preferably is 0.07 to 0.14 times the width across flats SW.

FIG. 3 is a side view of spring washer 21. It shows that spring washer 21 has a turn W that follows an imaginary helix. As a result, ends 37 and 37' are not directly opposite but laterally offset with respect to each other. Spring washer 21 is thus crossed such that it is elastically supported against sidewalls 41 and 43 with its lateral surface 36 (FIG. 4). However, spring washer 21 can also have an undulating design, to provide a quasi wave-shaped spring washer. Finally, a crossed spring washer 21 can have an undulating design as well.

FIG. 4 schematically shows actuating tool 1 in a side elevation, in which the polygon arrangement has been omitted for the sake of clarity. It may be seen that spring washer 21 is centered with respect to a longitudinal axis 45 of actuating tool 1, whereby spring washer 21 is shown in its no-load state, i.e., spaced at a distance from groove bottom 35. FIG. 4 clearly shows that tool head 5 is formed by spherical segments 20 and 25 and truncated cone 27. It also clearly shows that recess 17 extends in plane E1, with a normal of said plane E1 coinciding with longitudinal axis 45. In other respects, identical parts are identified by the same symbols as in FIG. 1; to that extent reference is made to their description.

FIG. 5 is a sectional view of actuating tool 1, whereby longitudinal axis 45 is located in the sectional plane. Parts that are identical to those in FIGS. 1 to 4 are identified by the same symbols; to that extent they are not re-described here. FIG. 5 again shows that tool head 5 is formed by the first and second spherical segment 20 and 25 and truncated cone 27. The bases of the first and second spherical segments 20 and 25 are facing each other and are preferably arranged so that they are spaced at a distance x from each other reflecting the width of recess 17 or groove 19. A center point $M_1$ of the first spherical segment 14 and a center point $M_2$ of the second spherical segment 25 are located at a distance from each other along longitudinal axis 45 of actuating tool 1 within a space between the bases of spherical segments 20 and 25. Diameter r of the first and second spherical segment 20 and 25 is preferably slightly larger than half the width across flats SW. In other words, the largest diameter of the tool head, which corresponds to the width across flats SW of the polygon arrangement, is reached at the junction between sidewall 41 of groove 19 and face 23 of the second spherical segment 25.

If the actuating tool is to be used at an angle with respect to the axis of the screw (not depicted), the width across flats SW of the polygon arrangement is formed by faces 13 and 23. In other words, the distance between two diametrically opposite faces 13 and 23 corresponds to twice the radius r and defines the width across flats SW if actuating tool 1—as previously mentioned—is to be inserted at a pivoting angle into the internal polygon arrangement of the screw. The maximum pivoting angle of the actuating tool 1 in relation to the screw is determined by angle $\alpha$ formed by the lateral surface 31 of the truncated cone 27 with central axis 45. Specifically, this angle $\alpha$ can be 30° to 40°, in this case approximately 30°. Angle $\alpha$ thus determines the maximum permissible pivoting range of actuating tool 1 in relation to the screw. In other words, if tool head 5 is inserted into the internal polygon arrangement, actuating tool 1 can be pivoted until one face of hexagon arrangement 33 abuts against a side face of the internal polygon arrangement. Dimension M of the constriction must be adapted to angle $\alpha$, i.e., the diameter of constriction 11 must be dimensioned such that at the maximum pivoting angle, contact between actuating tool 1 in the area of constriction 11 and a screw is prevented. If tool head 5 is to be inserted into the internal hexagon arrangement of the screw at a pivoting angle greater than the maximum permissible pivoting angle, the attached truncated cone 27 prevents tool head 5 from being inserted into the screw. This is achieved in that the longitudinal extension of truncated cone 27 is selected such that at least one limiting edge of the internal polygon arrangement of the screw meets truncated face 29, or a transitional edge 47 between lateral surface 31 and truncated face 29 is wedged with an interior surface of the screw, since a distance of transitional edge 47 to a face 13 is greater than the width across flats SW. Truncated cone 27 thus forms an insertion area of actuating tool 1, which limits the pivoting angle and thus prevents damage to the screw and to tool head 5.

Figure 6A:
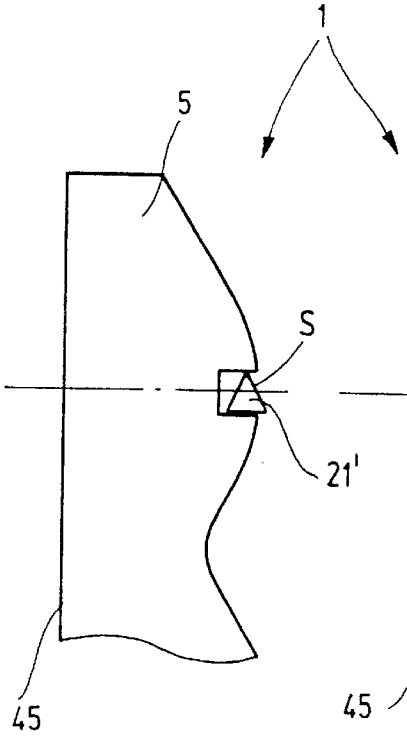
Figure 6B:
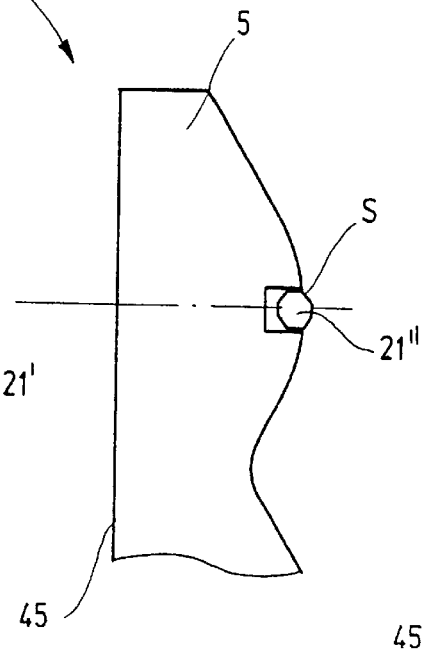
Figure 6C:
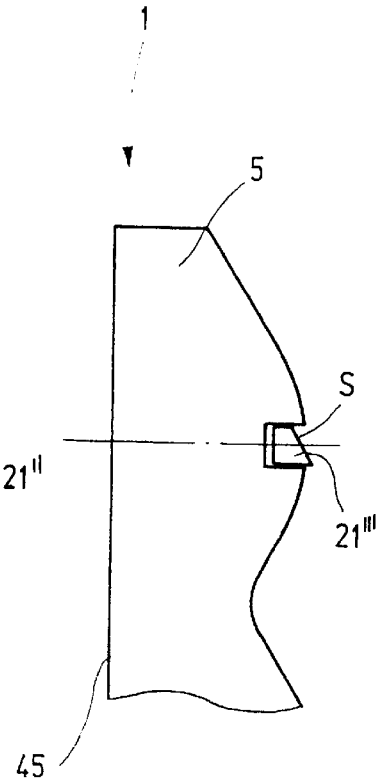
Figure 6D:
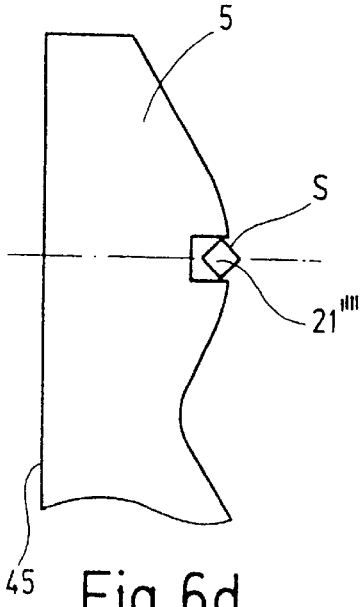

FIGS. 6*a* to 6*d* each show detail views of a tool head 5 of an actuating tool 1, which is distinguished from the exemplary embodiment discussed above only by different embodiments of the spring washer. FIG. 6*a* depicts a spring washer 21' the cross section of which is substantially triangular. FIG. 6*b* shows a substantially hexagonal spring washer 21", FIG. 6*c* a substantially trapezoidal spring washer 21'" and FIG. 6*d* a substantially rhombic spring washer 21"" in cross section. A particularly advantageous feature in these embodiments is that a diagonal S of spring washer 21', 21", 21'", and 21"" contacts a limiting edge of an internal polygon arrangement of a screw. The insertion force to be applied can be varied through the angle of the diagonal S with respect to longitudinal central axis 45. Due to the fact that this diagonal S is provided, when the spring washer meets the limiting edge of the internal polygon arrangement, a force component is produced, which radially acts on the spring washer to move the spring washer radially inwardly. Since a constant angle is present across the entire course of diagonal S, any insertion force to be applied is in all cases constant. To that extent, these spring washers are advantageous compared to round spring washers. The latter are distinguished by a variable insertion force.

Based on the above, it is readily apparent that tool head 5 can also be implemented without a truncated cone 27. In this case, too, optimal holding properties of spring washer 21 are realized. Thus, limiting the pivoting range of the actuating tool by means of the truncated cone 27 provides the additional advantage that at the maximum possible pivoting angle the spring washer remains engaged with the internal polygon arrangement and ensures a secure hold. It is also possible, however, to provide a spring washer for an actuating tool with a cylindrical tool head, which has a secure hold in engagement position with a screw and, furthermore, requires a nearly constant insertion force with each insertion process.

What is claimed is:

1. An actuating tool for a fastener having an internal polygon arrangement, the actuating tool comprising:

a tool head having a first generally hemispherical segment and a second generally hemispherical segment defining a spherical head having an external polygon arrangement for nesting in the internal polygon arrangement of the fastener, and a circumferential recess for receiving a spring washer, the circumferential recess having sidewalls and being disposed between the first and second generally hemispherical segments; and a spring washer disposed in the circumferential recess;

wherein the width of the recess is greater than the depth of the spring washer, and wherein the sidewalls of the recess at least partially support the washer.

2. The actuating tool according to claim 1, wherein the first generally hemispherical segment and the second generally hemispherical segment each have a base, and wherein the bases face each other and are disposed adjacent the recess.

3. The actuating tool according to claim 1, wherein the spring washer is open and wherein the spring washer defines a generally helical turn.

4. The actuating tool according to claim 1, wherein the actuating tool has a longitudinal access and wherein the recess of the tool head extends in a plane normal to the longitudinal axis of the actuating tool.

5. The actuating tool according to claim 1, wherein the first generally hemispherical segment and the second generally hemispherical segment has a cross-sectional shape which is polygonal.

6. The actuating tool according to claim 5, wherein the cross-sectional shape is triangular, rectangular or hexagonal.

7. The actuating tool according to claim 5, wherein the cross-sectional shape is trapezoidal.

8. The actuating tool according to claim 5, wherein the cross-sectional shape is rhombic.

9. The actuating tool according to claim 1, wherein the spring washer has a diameter, the first generally hemispherical segment and the second generally hemispherical segment have opposing flat surfaces spaced apart at a distance, and wherein the diameter of the spring washer is between 0.07 to 0.14 times the distance between the opposing flat surfaces.

10. The actuating tool according to claim 1, wherein the first generally hemispherical segment and the second generally hemispherical segment each have a center point, and wherein the center point of the first generally hemispherical segment is spaced apart from the second generally hemispherical segment.

11. The actuating tool according to claim 1, wherein the first generally hemispherical segment and the second generally hemispherical segment form a generally hemispherical head on a shank of an actuating tool.

12. The actuating tool according to claim 1, wherein one of the generally hemispherical segments comprises a truncated cone attached thereto, the truncated cone having lateral surfaces disposed at an angle of approximately 30 degrees relative to a longitudinal axis of the actuating tool.

13. The actuating tool according to claim 12, wherein the truncated cone has a polygon arrangement along its lateral surface.

14. The actuating tool according to claim 13, wherein the external polygon arrangement defines a hexagon.

15. An actuating tool for engaging and rotating a fastener, the actuating tool comprising:

a tool head having a first generally hemispherical segment defined by a plurality of generally flat surfaces and a second generally hemispherical segment defined by a plurality of generally flat surfaces, and a circumferential recess disposed between the first and second generally hemispherical segments for receiving a spring washer; and a spring washer disposed in the circumferential recess;

wherein the spring washer is not continuous and is formed with a generally helical wind; and wherein the recess in the tool head is sufficiently deep that the spring washer may completely nest inside the recess.

16. The actuating tool according to claim 15, wherein the tool head has a rounded portion between the generally flat surfaces of the first generally hemispherical segment and the second generally hemispherical segment, and wherein the recess is formed in the rounded portion.

17. The actuating tool according to claim 16, wherein the second generally hemispherical segment comprises a single hexagonal truncated cone.

18. The actuating tool according to claim 17, wherein the actuating tool has a longitudinal axis, and wherein the second generally hemispherical segment has a rounded portion and an end and a plurality of generally flat faces, each of the plurality of generally flat faces extending from the rounded portion to the end and being disposed at an angle of between about 30 degrees and 40 degrees relative to the longitudinal axis of the actuating tool.

19. The actuating tool according to claim 18, wherein the second hemispherical segment comprises a single hexagonal truncated cone.

20. The actuating tool according to claim 18, wherein the end of the second hemispherical segment is flat and normal to the longitudinal axis of the actuating tool.

21. The actuating tool according to claim 15, wherein the width of the recess is greater than the depth of the spring washer.

* * * * *